US009782621B2

(12) United States Patent
Chiang et al.

(10) Patent No.: US 9,782,621 B2
(45) Date of Patent: Oct. 10, 2017

(54) EXERCISE DEVICE PROVIDING AUTOMATIC BRAKING

(71) Applicant: Dyaco International Inc., Taipei (TW)

(72) Inventors: Hao Chiang, Taipei (TW); Brian Murray, Taipei (TW)

(73) Assignee: DYACO INTERNATIONAL INC., Taipei (TW)

( * ) Notice: Subject to any disclaimer, the term of this patent is extended or adjusted under 35 U.S.C. 154(b) by 178 days.

(21) Appl. No.: 14/220,637

(22) Filed: Mar. 20, 2014

(65) Prior Publication Data

US 2015/0174449 A1 Jun. 25, 2015

(30) Foreign Application Priority Data

Dec. 20, 2013 (TW) ..... 102147430 A

(51) Int. Cl.

| | |
|---|---|
| ***A63B 21/005*** | (2006.01) |
| ***A63B 24/00*** | (2006.01) |
| ***A63B 22/04*** | (2006.01) |
| ***A63B 22/06*** | (2006.01) |
| ***A63B 71/00*** | (2006.01) |
| ***A63B 21/22*** | (2006.01) |

(52) U.S. Cl.

CPC ..... *A63B 22/0605* (2013.01); *A63B 21/225* (2013.01); *A63B 24/0087* (2013.01); *A63B 71/0054* (2013.01); *A63B 2022/0652* (2013.01); *A63B 2024/0093* (2013.01); *A63B 2071/0081* (2013.01); *A63B 2220/16* (2013.01); *A63B 2220/24* (2013.01); *A63B 2220/34* (2013.01); *A63B 2220/35* (2013.01); *A63B 2220/44* (2013.01)

(58) Field of Classification Search

USPC ..... 482/1, 4–6

See application file for complete search history.

(56) References Cited

U.S. PATENT DOCUMENTS

| | | | | |
|---|---|---|---|---|
| 4,824,104 | A | 4/1989 | Bloch | |
| 4,986,261 | A * | 1/1991 | Iams | A61H 1/0218 482/51 |
| 2002/0107113 | A1* | 8/2002 | Mosley | A63B 22/02 482/54 |
| 2003/0158016 | A1* | 8/2003 | Kolda et al. | 482/61 |
| 2006/0094569 | A1* | 5/2006 | Day | A63B 21/015 482/57 |
| 2009/0156362 | A1* | 6/2009 | Berg | A63B 21/0616 482/2 |
| 2009/0181832 | A1* | 7/2009 | Bell | 482/72 |

FOREIGN PATENT DOCUMENTS

| | | |
|---|---|---|
| CN | 2782154 Y | 5/2006 |
| TW | M274122 U | 9/2005 |
| TW | I284180 B | 7/2007 |

* cited by examiner

*Primary Examiner* — Andrew S Lo
*Assistant Examiner* — Shila Jalalzadeh Abyan
(74) *Attorney, Agent, or Firm* — Huffman Law Group, PC

(57) ABSTRACT

An exercise device comprises a flywheel, a driving assembly, and a control assembly. The driving assembly drives the flywheel to rotate. The control assembly comprises an angle sensor for measuring the change of angular displacement of the flywheel during a specific period of time. The control assembly calculates the angular velocity or the angular acceleration of the flywheel by the measured angular displacement during the specific period of time. The control assembly determines if the flywheel is to be stopped according to at least a criterion.

7 Claims, 5 Drawing Sheets

EXERCISE DEVICE PROVIDING AUTOMATIC BRAKING

CROSS-REFERENCE TO RELATED APPLICATIONS

The entire contents of Taiwan Patent Application No. 102147430, filed on Dec. 20, 2013, from which this application claims priority, are incorporated herein by reference.

BACKGROUND OF THE INVENTION

1. Field of the Invention

The present invention relates to exercise devices, and more particularly relates to an exercise device providing automatic braking function.

2. Description of Related Art

Flywheels typically constitute rotating devices useful for storing rotational energy. A flywheel is a spinning wheel rotor with a fixed axis whereby energy is stored in the rotor as rotational energy. Flywheels have a moment of inertia and thus resist changes in rotational speed. The rotational energy is proportional to the square of its rotational speed.

The flywheel has been applied in many types of exercise device. The rotational speed of the flywheel can be increased by applying torque to it. Due to the inertia, the flywheel keeps rolling even if the user stops applying torque to it by movements of his or her legs. Therefore, the knees of the user could be injured by the flywheel not stopping.

SUMMARY OF THE INVENTION

In one general aspect, the present invention relates to exercise devices, and more particularly relates to an exercise device providing automatic braking function.

In an embodiment of the present invention, an exercise device is provided with a flywheel, a driving assembly, and a control assembly. The driving assembly drives the flywheel. The control assembly comprises an angle sensor for measuring the change of angular displacement of the flywheel during a specific period of time. The control assembly calculates the angular velocity or the angular acceleration of the flywheel by the measured angular displacement, and the control assembly determines if the flywheel is to be stopped according to at least a criterion.

In another embodiment of the present invention, an automatic braking method for an exercise device comprising a flywheel, a driving assembly, and a control assembly is provided with the steps of: measuring a radian or an angle of a rotational movement of the flywheel during a predetermined period of time; calculating an angular velocity or an angular acceleration of the flywheel by the measured angular displacement during the predetermined period of time; and determining if the flywheel is to be stopped according to at least a criterion.

DETAILED DESCRIPTION OF THE PREFERRED EMBODIMENT

Reference will now be made in detail to those specific embodiments of the invention. Examples of these embodiments are illustrated in the accompanying drawings. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components. Wherever possible, the same or similar reference numbers are used in drawings and the description to refer to the same or like parts.

Figure 1A:
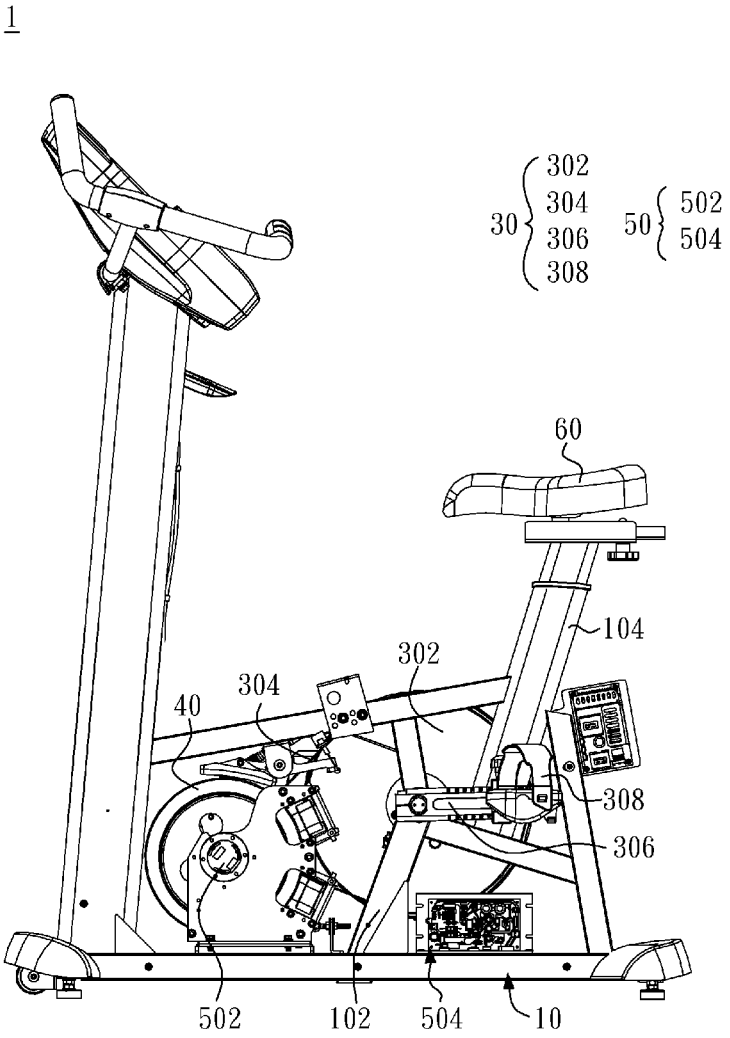
FIGS. 1A and 1B are a side view and a perspective view, respectively, showing an exercise device according to a preferred embodiment of the present invention.
Figure 1B:
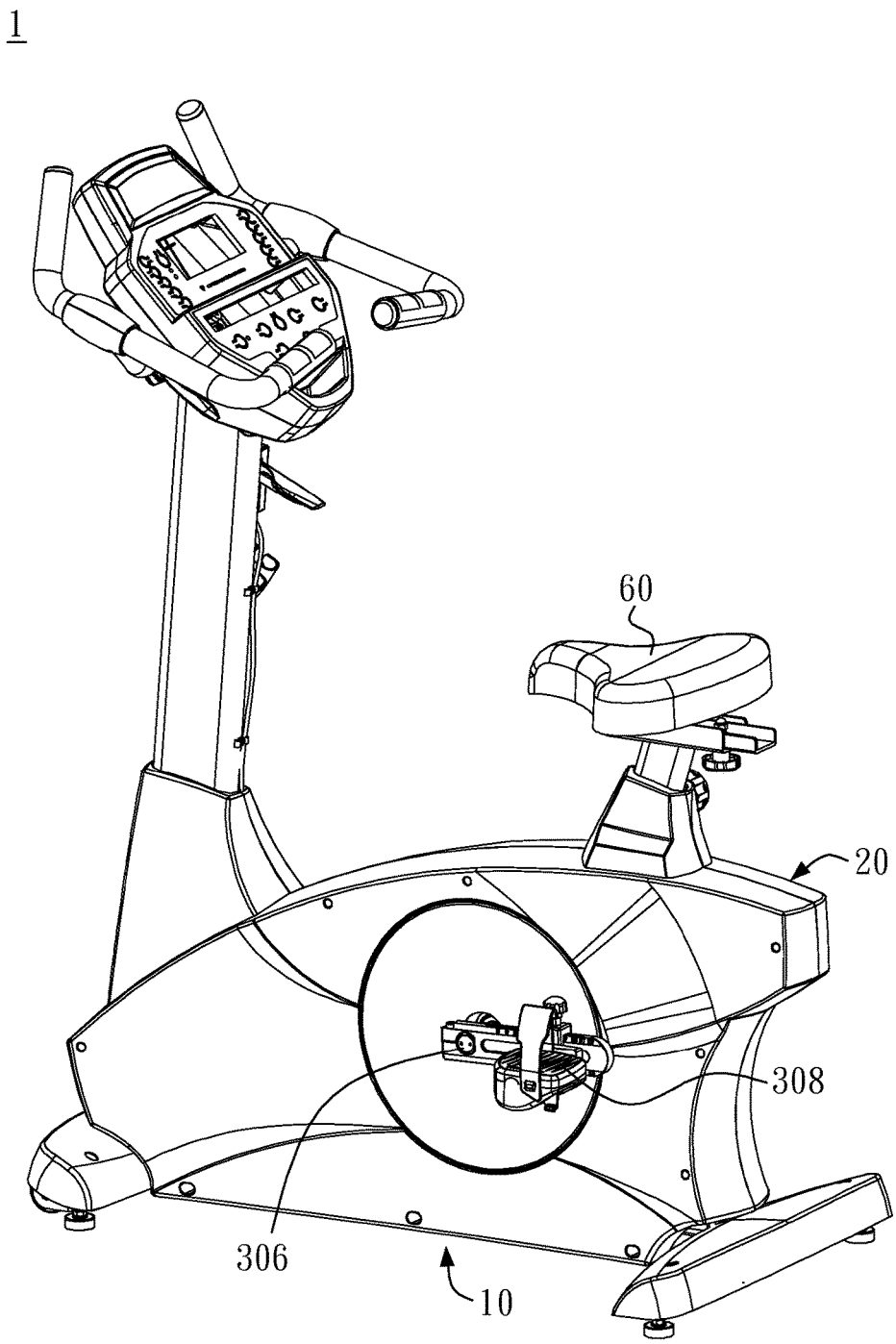

FIGS. 1A and 1B are a side view and a perspective view, respectively, showing an exercise device according to a preferred embodiment of the present invention, in which a housing is omitted from FIG. 1B for clarity of essential components of the exercise device.

As shown in FIGS. 1A and 1B, the exercise device 1 may comprise a frame 10, a housing 20, a driving assembly 30, a flywheel 40, a control assembly 50, and a seat 60. A user sits on the seat 60 and drives the flywheel 40 to rotate via the driving assembly 30. The control assembly 50 determines if the flywheel 40 is to be stopped according to a method and/or at least a criterion. The detail is described as follows.

In this preferred embodiment, the driving assembly 30 couples with the frame 10 and may comprise, but is not limited to, a driving wheel 302, a connecting member 304, two cranks 306, and two pedals 308. The frame 10 may comprise, but is not limited to, a bracket 102 and a supporting post 104. The driving wheel 302 may couple with the bracket 102, and the seat 60 may couple with the supporting post 104.

In addition, the driving wheel 302 indirectly connects to and drives the flywheel 40 via the connecting member 304. For instance, a small wheel (not shown) may couple to the flywheel 40 with a common axis, and the small wheel connects with the driving wheel 302 via the connecting member 304. The small wheel and the driving wheel 302 may be, but is not limited to, a pulley, a sprocket, a gear, or a timing pulley, gear, or wheel. The connecting member 304 may be, but is not limited to, a belt, a gear, or a timing gear or a timing belt corresponsive to the driving wheel 302. In this embodiment, the driving wheel 302 and the small wheel are pulley, and the connecting member 304 is a belt.

Further, each crank 306 has two ends, in which one end couples to an axle of the driving wheel 302 and the other couples to one of the two pedals 308.

A user sits on the seat 60 with his or her feet respectively putting on the one of the two pedals 308. When the user simulates to ride a bicycle, the driving wheel 302 drives the flywheel 40 to rotate via the connecting member 304. In this embodiment, the flywheel 40 can rotate in two directions, namely, clockwise and counterclockwise directions.

Figure 2:
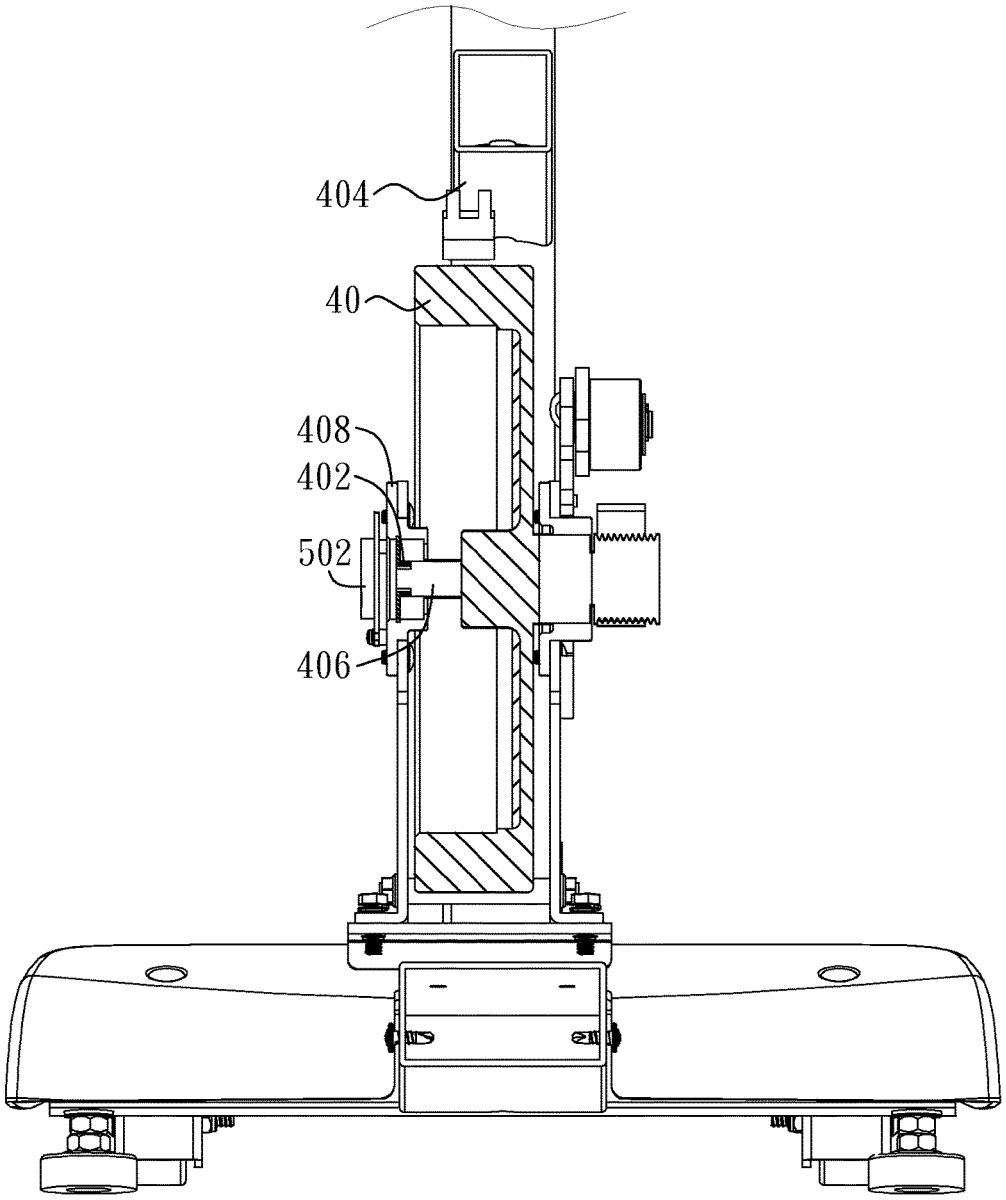
FIG. 2 shows an angle sensor mounted on a flywheel of the exercise device according to a preferred embodiment of the present invention.

Moreover, the control assembly 50 may further comprise an angle sensor 502 and a printed circuit board 504. The angle sensor 502 is used to measure the radian or the angle of the rotational movement of the flywheel 40 during a predetermined period of time. The measured result is transmitted to the printed circuit board 504. FIG. 2 shows the angle sensor 502 is mounted on the flywheel 40 of the exercise device according to a preferred embodiment of the present invention. The flywheel 40 couples to a supporter 404. A magnet 402 is mounted on an axle 406 of the flywheel 40, and a surface of the magnet 402 has an N-pole and an S-pole. The angle sensor 502 couples to the supporting piece 408 of the flywheel 40, and the center of the angle sensor aims at the magnet 402.

Figure 3:
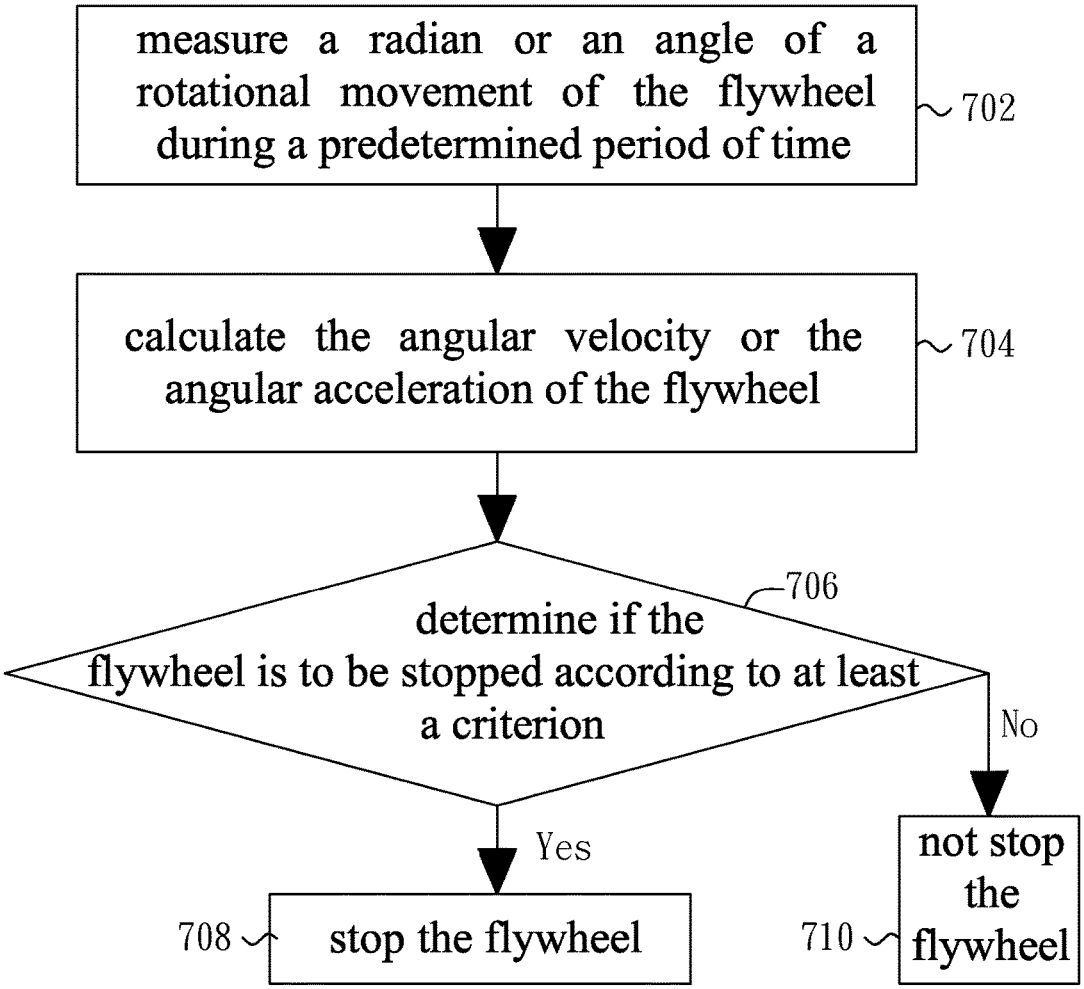
FIG. 3 is a flowchart showing an automatic braking method according to a preferred embodiment of the present invention.

FIG. 3 is a flowchart showing an automatic braking method according to a preferred embodiment of the present invention. The control assembly 50 executes this method and determines whether the flywheel 40 is to be stopped or not stopped. Step 702, the radian or the angle of the rotational movement of the flywheel 40 during a predetermined period of time is measured by the angle sensor. Step 704, the angular velocity or the angular acceleration of the flywheel 40 is calculated by the measured angular displacement during the predetermined period of time. Step 706, the control assembly 50 determines if the flywheel 40 is to be stopped according to at least a criterion. For example, if the calculated angular acceleration of the flywheel 40 is equal to or more than a predetermined value, then the automatic braking step, i.e., step 708, is executed. If the criterion is not satisfied, then step 710 is executed, and the flywheel 40 is not stopped and keeps turning around. In step 708, any method or mechanism known in the art, such as drum brake, disk brake, oil brake, air brake, or dynamic brake, can be used to stop the flywheel 40.

Except the exercise device shown in FIGS. 1A and 1B, the foregoing mechanism and method can be applied to other types of exercise device.

Figure 4:
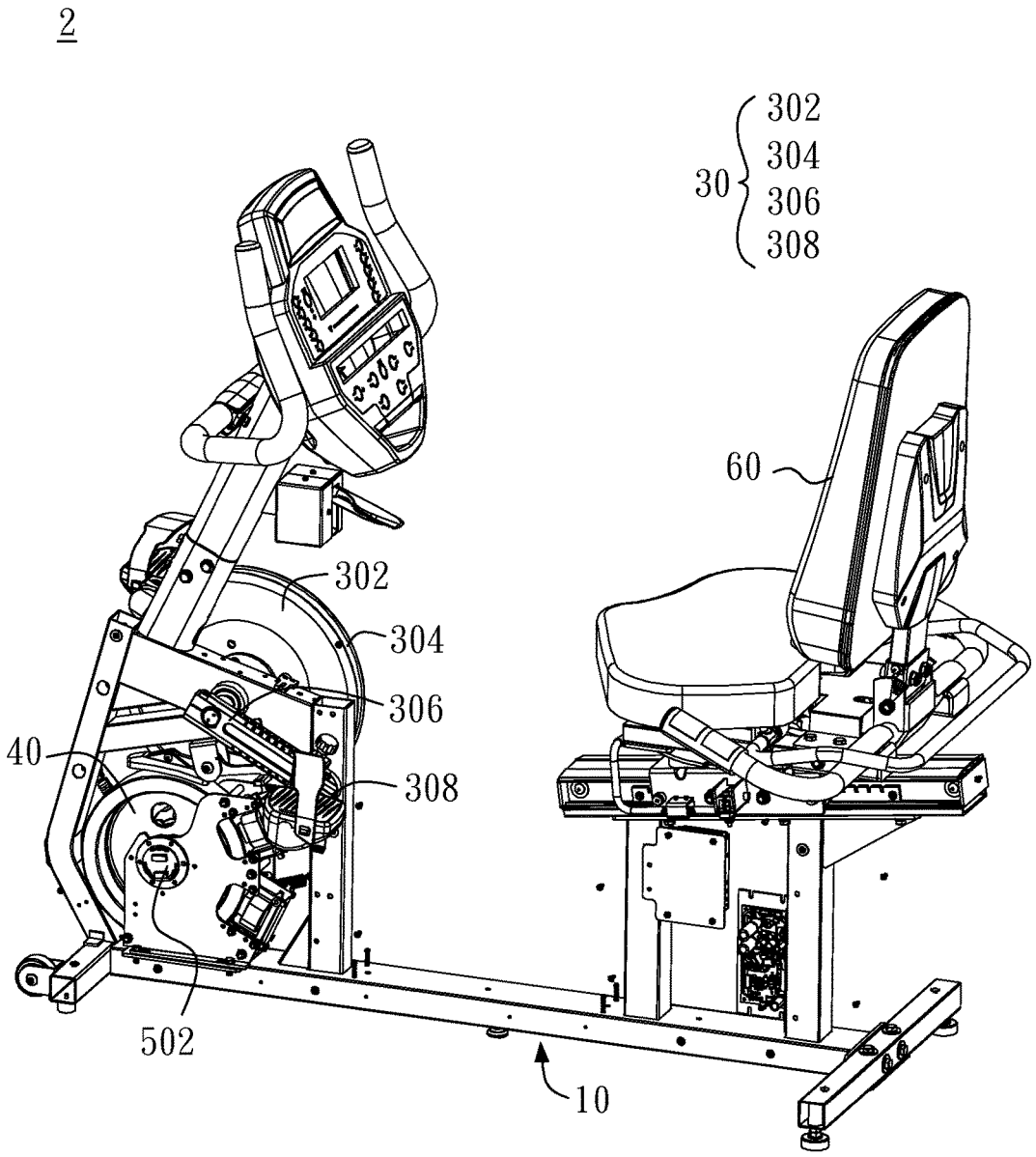
FIG. 4 is a perspective view showing another exercise device according to another preferred embodiment of the present invention.

FIG. 4 is a perspective view showing another exercise device according to another preferred embodiment of the present invention, in which a housing is omitted from FIG. 4 for clarity of essential components of the exercise device.

As shown in FIG. 4, the exercise device 2 may comprise a frame 10, a driving assembly 30, a flywheel 40, a control assembly 50, and a seat 60. The function and the use of those components may be the same or similar to the foregoing embodiment and therefore are omitted.

For a person skilled in the art, alternatives, modifications, and equivalents may be made for the above-mentioned configuration, and those alternatives, modifications, and equivalents are within the scope of the present invention. For example, the driving wheel 302 and the flywheel 40 can be combined as a single wheel in another embodiment. In this case, the angle sensor 502 can be mounted on the single wheel, and the connecting member 304 can be omitted.

Accordingly, embodiments of this invention provide exercise devices and automatic braking method that can protect the knees of the user from harm by the inertia of the flywheel.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

Although specific embodiments have been illustrated and described, it will be appreciated by those skilled in the art that various modifications may be made without departing from the scope of the present invention, which is intended to be limited solely by the appended claims.

What is claimed is:

1. An exercise device for protecting knees of a user from harm by inertia, comprising:

a flywheel generating inertia when rotated by the user;

a driving assembly for driving the flywheel;

a control assembly comprising an angle sensor for measuring angular displacement of the flywheel during a specific period of time, the control assembly calculating an angular acceleration of the flywheel by the measured angular displacement; and a brake member to automatically stop the flywheel directly in response to the calculated angular acceleration of the flywheel being equal to or more than a predetermined value so as to protect the knees of the user from harm by the inertia of the flywheel.

2. The exercise device as set forth in claim 1, wherein the driving assembly comprise a driving wheel, a connecting member, two cranks, and two pedals, and wherein the driving wheel indirectly connects to and drives the flywheel via the connecting member, and each crank has two ends in which one end couples to an axle of the driving wheel and the other couples to one of the two pedals.

3. The exercise device as set forth in claim 2, further comprises a frame and a seat, wherein the frame comprises a bracket and a supporting post, the driving wheel couples with the bracket, and the seat couples with the supporting post.

4. The exercise device as set forth in claim 1, wherein the flywheel couples to a supporter, a magnet is mounted on an axle of the flywheel, a surface of the magnet has an N-pole and an S-pole, the angle sensor couples to the supporter, and the center of the angle sensor aims at the axle of the flywheel.

5. The exercise device as set forth in claim 1, wherein the brake member is a drum brake, a disk brake, an oil brake, an air brake, or a dynamic brake.

6. An automatic braking method for protecting the knees of a user from harm by inertia of an exercise device comprising a flywheel generating interia when rotated by the user, a driving assembly driving the flywheel, and a control assembly comprising an angle sensor and executing the automatic braking method, which comprises the steps of:

measuring an angle of a rotational movement of the flywheel during a predetermined period of time;

calculating an angular acceleration of the flywheel by the measured angle of the rotational movement of the flywheel during the predetermined period of time; and automatically stopping the flywheel directly in response to the calculated angular acceleration of the flywheel being equal to or more than a predetermined value.

7. The automatic braking method as set forth in claim 6, wherein a drum brake, a disk brake, an oil brake, an air brake, or a dynamic brake is used to stop the flywheel.

* * * * *